US007333745B2

(12) United States Patent
Han et al.

(10) Patent No.: US 7,333,745 B2
(45) Date of Patent: Feb. 19, 2008

(54) POWER SUPPLY DEVICE AND ELECTRONIC APPARATUS EMPLOYING THE SAME

(75) Inventors: Jae-hee Han, Suwon (KR); In-sik Seo, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/870,951

(22) Filed: Jun. 21, 2004

(65) Prior Publication Data

US 2005/0031368 A1 Feb. 10, 2005

(30) Foreign Application Priority Data

Aug. 5, 2003 (KR) ..... 10-2003-0053977

(51) Int. Cl.
*G03G 15/00* (2006.01)

(52) U.S. Cl. ..... 399/88; 399/90; 399/37

(58) Field of Classification Search ..... 399/88, 399/89, 90, 107, 124, 37
See application file for complete search history.

(56) References Cited

U.S. PATENT DOCUMENTS 5,918,089 A * 6/1999 Malinich et al. ..... 399/90
6,757,504 B2 * 6/2004 Amano ..... 399/88

FOREIGN PATENT DOCUMENTS

| | | |
|---|---|---|
| JP | 03-184279 | 8/1991 |
| JP | 03-184279 | * 12/1991 |
| JP | 2001-251067 | 9/2001 |
| JP | 2002-031924 | 1/2002 |
| KR | 198-068431 | 12/1998 |
| KR | 1999-024341 | 5/1999 |

OTHER PUBLICATIONS

Korean Official Action issuedon May 23, 2005, for Korean Patent Application No. 2003-53977 (listing 1 reference).

* cited by examiner

*Primary Examiner*—Hoang Ngo
(74) *Attorney, Agent, or Firm*—Stanzione & Kim, LLP

(57) ABSTRACT

An electronic apparatus and a power supply device used with the electronic apparatus is capable of automatically shutting off power from a power supply to the electronic apparatus when an access cover is opened. The electronic apparatus includes a casing that houses a power control unit therein, and having one end open, an access cover disposed at the casing to open and close the open side of the casing, and a power supply device that connects an external power source to the power control unit. The power supply device shuts the power control unit off from the external power source when the open side is open. Accordingly, when the access cover is opened for the operations such as additional installation of the optional item or replacement of inner parts with new ones, the external power supply is automatically shut off. Therefore, accidents such as electrocution or burns, can be prevented, and damage to the electronic apparatus caused by the electrical shock can also be prevented.

24 Claims, 5 Drawing Sheets

POWER SUPPLY DEVICE AND ELECTRONIC APPARATUS EMPLOYING THE SAME

CROSS-REFERENCE TO RELATED APPLICATIONS

This application claims benefit under 35 U.S.C. § 119 from Korean Patent Application No. 2003-53977, filed on Aug. 5, 2003, the entire content of which is incorporated herein in its entirety.

BACKGROUND OF THE INVENTION

1. Field of the Invention

The present general inventive concept relates to an electronic apparatus, and more particularly, to an electronic apparatus having a power supply device which is capable of shutting off a power supply to the electronic apparatus in response to an access cover separating from a casing to provide the maintenance or repair of the apparatus.

2. Description of the Related Art

Generally, an electronic apparatus has an opening to be opened and closed by an access cover in order to allow a user to easily add an optional item in the apparatus or replace inner parts of the apparatus with new ones.

FIG. 1 illustrates a printer as an example of an electronic apparatus. Referring to FIG. 1, the electronic apparatus 100 includes a casing 110 defining an exterior of the electronic device, an access cover 120 opening and closing an opening 115 formed in one side of the casing 110, a power cable 10 connected to an external utility power source, and a socket (not shown), into which a plug (not shown) of the power cable 10 is removably connected.

The conventional electronic apparatus with the above construction keeps receiving power supply through the power cable 10 and the socket (not shown) unless there is a separate operation performed to shut off power from the utility power supply. The power supply continues to provide power even when the access cover 120 is open. This is problematic because the user may cause shock to the circuits inside, by mistakes or carelessness, while he/she is working on the maintenance or repair of the apparatus in a state that the utility power is being supplied, which would then cause a disorder of the apparatus. Also, if the apparatus has the inner parts being operated by a high-voltage and at a high temperature such as in the case of a printer, there is a problem of an accident such as electrocution or burns.

SUMMARY OF THE INVENTION

The present general inventive concept has been developed in order to solve the above and/or other drawbacks and problems associated with the conventional arrangement. An aspect of the present general inventive concept is to provide an electronic apparatus and a power supply device used with the electronic apparatus, which is capable of automatically shutting off power from a power supply to the electronic apparatus when an access cover is opened.

Additional aspects and advantages of the present general inventive concept will be set forth in part in the description which follows and, in part, will be obvious from the description, or may be learned by practice of the general inventive concept.

The above and/or other aspects of the general inventive concept are achieved by providing an electronic apparatus including a casing to house a power control unit therein, and having one end open, an access cover disposed at the casing to open and close the open side of the casing, and a power supply device that connects an external power source to the power control unit. The power supply device shuts the power control unit off from the external power source when the open side is open.

Accordingly, when the access cover is opened for the operations such as additional installation of the optional item or replacement of inner parts with new ones, the external power supply is automatically shut off. Therefore, accidents, such as electrocution or burns, can be prevented, and damage to the electronic apparatus caused by electrical shocks can also be prevented.

The power supply device may include a first power connection unit disposed at the access cover and removably connected with the external power source, and a second power connection unit disposed inside the casing and electrically connected to the power control unit. The second power connection unit is selectively connected to the first power connection unit in accordance with the movements of the access cover opening and closing the open side.

The first power connection unit may include a first connection portion exposed to the outside of the casing when the access cover is closed, to be removably connected to a plug connected to the external power source, a second connection portion positioned inside the casing when the access cover is closed, to be removably connected to the second power connection unit, and a connection body penetrating through the access cover to electrically connect the first and the second connection portions.

The connection body may be embodied as a cable, a FPC, and a substrate.

The second power connection unit may include a third connection portion identical to the plug with respect to its shape, and the second connection portion of the first power connection unit may be identical to the first connection portion with respect to its shape, and the second connection portion is removably connected with the third connection portion when the first power connection unit is connected with the second power connection unit.

The connections between the first power connection unit and a power cable and between the first power connection unit and the second power connection unit may be achieved by using a plug and a socket. However, this should not be considered as limiting, and any embodiment is possible if removable and safe connection can be guaranteed.

The second and the third connection portions can be connected to and disconnected from each other in a parallel direction to a direction in which the access cover moves to open and close the open side.

The first connection portion and the plug are connected and separated with/from each other in a parallel direction to a direction in which the access cover moves to open and close the open side. The connection body is fixed to the access cover to penetrate through the access cover and has opposite ends connected with the first and the second connection portions.

In another embodiment of the general inventive concept, the first connection portion and the plug may be connected to and separated from each other at a predetermined angle with respect to a direction in which the access cover moves to open and close the open side. In this case, the connection body is fixed to the access cover to penetrate through the access cover and includes a body that connects the first and the second connection portion at a predetermined angle with each other.

The access cover may be removably or pivotably connected to the open side of the casing.

The electronic apparatus may further include a first guide portion formed at one of the access cover and the casing and a second guide portion formed at the other one of the access cover and the casing and corresponding to the first guide portion. The first and the second guide portions guide a sliding movement of the access cover along a side surface of the casing when the access cover is removably mounted on the casing.

The second power connection unit is disposed on an inner side of the casing adjacent to the open side to be connected to the first power connection unit, and is electrically connected to the power control unit through predetermined power connection means.

The electronic apparatus may further include a mounting portion disposed inside the casing to mount an optional item through the open side. The optional item may include a network interface card and a memory.

According to another embodiment of the general inventive concept, a socket for an electronic apparatus may include a socket body fixed to a casing of the electronic apparatus, a first connection portion disposed at one side of the socket body exposed to the outside of the electronic apparatus to be removably connected to a first plug of an external power cable, and a second connection portion disposed at the other side of the socket body provided inside the electronic apparatus to be removably connected to a second plug provided inside the electronic apparatus.

The socket body may be disposed at an access cover to open and close the casing of the electronic apparatus, and the second connection portion and the second plug are connected to and separated from each other in accordance with the movement of the access cover closing and opening the casing of the electronic apparatus.

The first connection portion and the second connection portion may be identical to each other with respect to their shape.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
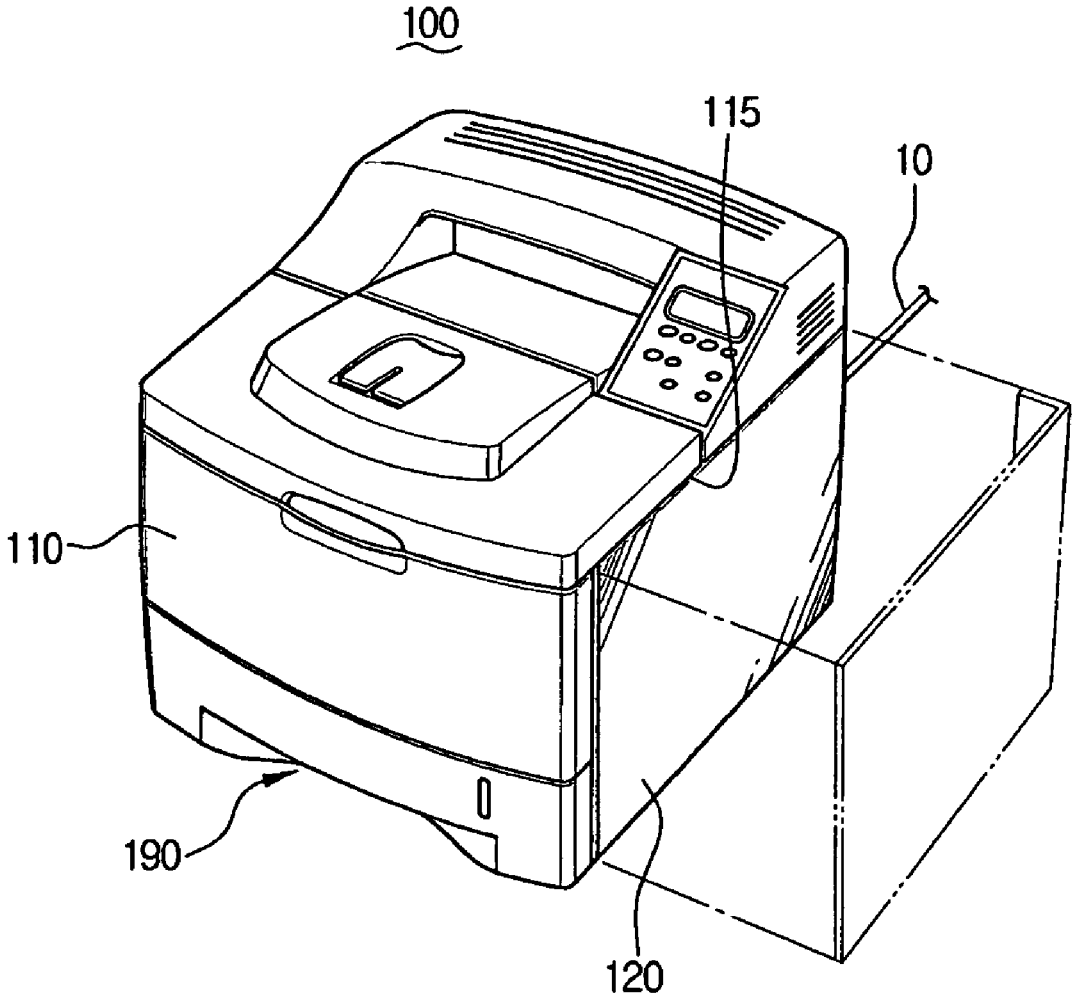
FIG. 1 (PRIOR ART)
FIG. 1 is a perspective view showing a laser beam printer as an example of a conventional electronic apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
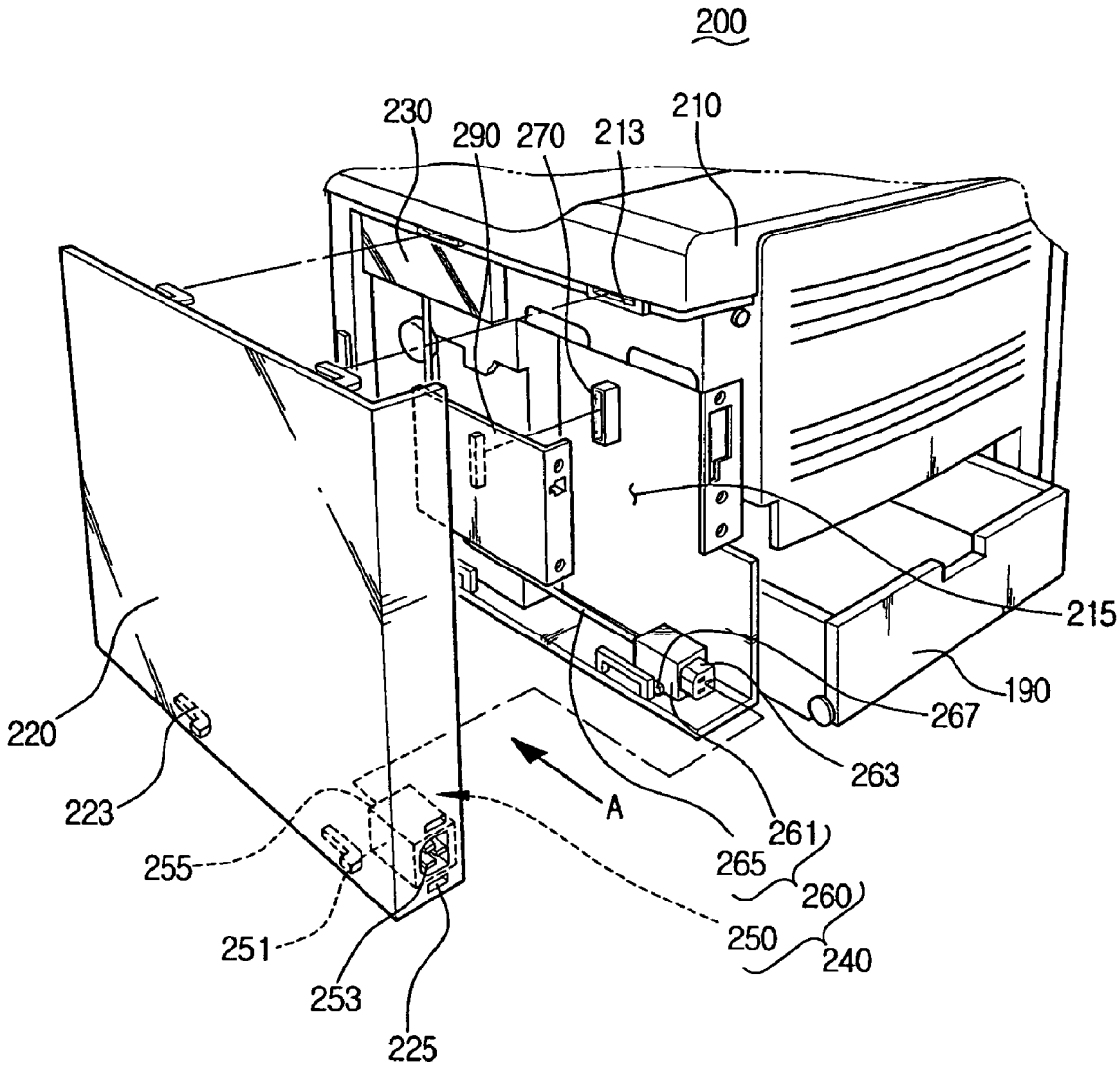
FIG. 2 is a perspective view showing a partial exterior of a laser beam printer according to an embodiment of the present general inventive concept.
Figure 3:
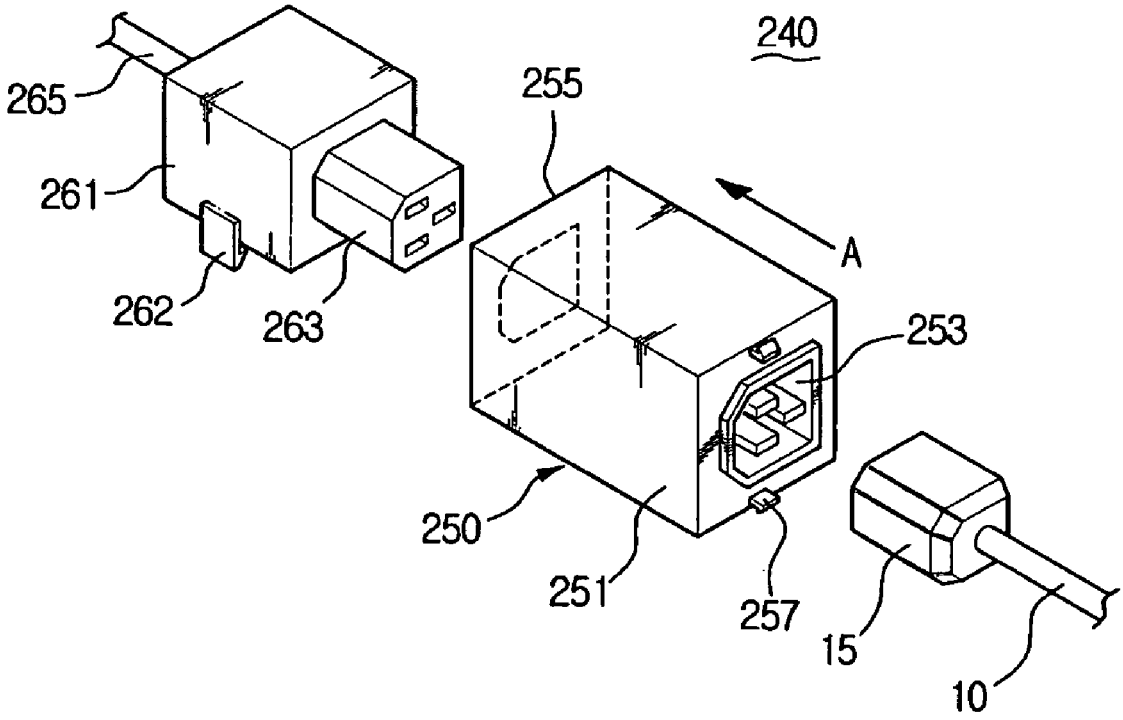
FIG. 3 is an exploded perspective view showing the power supply device of FIG. 2.

FIGS. 2 and 3 illustrates a laser beam printer as an example of an electronic apparatus. As shown in FIGS. 2 and 3, the printer 200 according to this embodiment may include a casing 210, an access cover 220, and a power supply device 240.

Parts such as an image forming unit (not shown), a paper feeder 190, a power control unit 230, and a mounting portion 270 are provided in the casing 210. The power control unit 230 converts an externally-applied power into suitable voltage and electric current for the printer 200, and distributes the voltage and the electric current to the respective parts. The mounting portion 270 can be used to mount an optional item 290 to extend the function of the electronic apparatus 200. The mounting portion 270 may be omitted/added depending on the kind of the electronic apparatus 200. If the electronic apparatus 200 is a printer as in this embodiment, a network interface card or a memory card can be mounted as the optional item 290. Meanwhile, since the image forming unit (not shown) and the paper feeder 190 are identical to those used in general laser beam printers, detailed descriptions thereof will be omitted for conciseness.

An opening 215 is penetratingly formed in one side of the casing 210. It is preferred that the opening 215 is defined in a position which allows easy replacement of the inner parts of the electronic apparatus 200 and easy mounting of the optional item 290. In this embodiment, the opening 215 is defined in a position opposite to the mounting portion 270. In order to prevent foreign matters from entering into the electronic apparatus 200, it is preferred that the opening 215 is generally closed. Accordingly, the electronic apparatus 200 includes the access cover 220 disposed at the casing 210 to open and close the opening 215. The access cover 220 may take various formations and installing positions according to the type and the interior contour of the electronic apparatus 200. In another embodiment, the access cover 220 may be slidably connected to the casing 210 to completely open and close the opening 215. The separation/connection of the access cover 220 is achieved by the cooperation of a guide rail 213 disposed on the casing 210 and a slide protrusion 223 formed on the access cover 220.

The power supply device 240 supplies the power control unit 230 with an external utility power, and includes a first power connection unit 250 and a second power connection unit 260.

The first power connection unit 250 is shaped as a socket, which includes a socket body 251, a first connection portion 253, and a second connection portion 255. The first power connection unit 250 is disposed on one side of the access cover 220 to shut off a power supply to the power control unit 230 in response to the access cover 220 separating from the casing 210. The socket body 251 is fixed to the access cover 220 by adequate fixing means. In this embodiment, a fixing protrusion 257, integrally formed with the socket body 251, is hooked into a fixing hole 225 of the access cover 220 so that the socket body 251 is fixed to the access cover 220. The socket body 251 may be omitted if the first and the second connection portions 253 and 255 are electrically connected to each other while penetrating through the access cover 220 by predetermined electric connection means such as a cable. The first connection portion 253 is formed on one side of the socket body 251 which is exposed to the outside of the electronic apparatus when the access cover 220 is closing the opening 215, and is removably connected to a first plug 15 of a power cable 10. The second connection portion 255 is formed on the other side of the socket body 251 which is positioned inside the electronic apparatus 200 when the access cover 220 is closing the opening 215, and is separably connected to the second power connection unit 260 which will be described later.

The second power connection unit 260 includes a second plug 263 removably connected to the second connection portion 255 when the access cover 220 is closing the opening 215, and a cable 265 electrically connecting the second plug 263 to the power control unit 230. The second plug 263 is fixed to the casing 210 by adequate fixing means such as a fixing protrusion 267. Various methods can be used for the fixing of the second plug 263, however, the fixing has to make sure that the second plug 263 is not moved when the second plug 263 is connected to the second connection portion 255 of the first power connection unit. If the second power connection unit 260 is integrally formed with the power control unit 230, the cable 265 may be omitted.

In this embodiment, the second plug 263 is connected to the second connection portion 255 in the same manner as the first plug 15 is connected to the first connection portion 253. In this case, the first and the second plugs 15 and 263 are identical to each other in shape, and the first and the second connection portions 253 and 255 are also identical to each other in shape, corresponding to the shapes of the first and the second plugs 15 and 263, so that the first and the second plugs 15 and 263 are not connected to each other. Accordingly, when the access cover 220 is open, the first and the second plugs 15 and 263 are prevented from being connected to each other so that the power supply to the power control unit 230 is prevented.

A direction in which the second plug 263 is connected to the second connection portion 255 has to be parallel, or substantially parallel to a direction in which the access cover is mounted on the casing 210. The second plug 263 and the second connection portion 244 are disposed in a manner so that the second plug 263 is fitted into the second connection portion 255 when the access cover 220 is moved in the direction A to be mounted on the casing 210. Accordingly, when the access cover 220 is separated from the casing 210, the external utility power supply to the power supply control unit 230 is automatically shut off. It is not required to install an extra locking device to lock the access cover 220 onto the casing 210 because the access cover 220 is locked onto the casing 210 in a closed state by the connection of the second connection portion 255 and the second plug 263. Therefore, the electronic apparatus 200 can be simplified in its construction. A direction in which the first plug 15 is connected to the first connection portion 253 may be parallel, or substantially parallel to the direction A in which the access cover 220 is mounted on the casing 210 in the same manner as the case where the second plug 263 is connected to the second connection portion 255.

Figure 4:
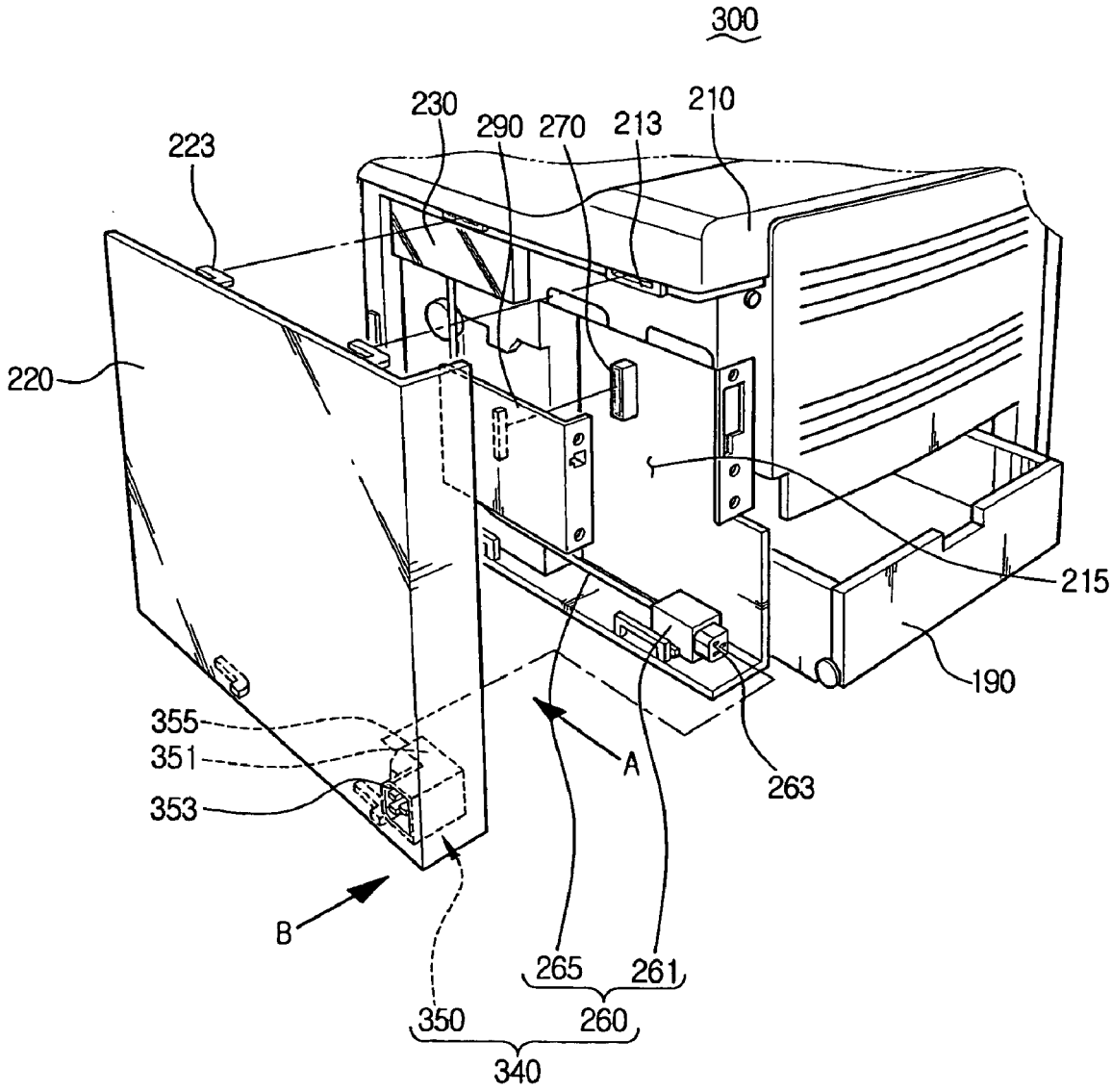
FIG. 4 is a perspective view showing a partial exterior of a laser beam printer according to another embodiment of the present general inventive concept.

FIG. 4 is a view showing an electronic apparatus 300 according to another embodiment of the present general inventive concept. The embodiment of FIG. 4 differs from the previous embodiment in that a direction B in which a first connection portion 353 of a first power connection unit 350 is connected to the first plug 15 is perpendicular, or substantially perpendicular to the direction A in which the access cover 220 is connected to the casing 210. In this case, the first connection portion 353 and a second connection portion 355 are connected at a predetermined angle with each other, and a part of a socket body 351 is curved. Since the other elements are identical to those of the previous embodiment, detailed descriptions thereof will be omitted for conciseness.

Figure 5:
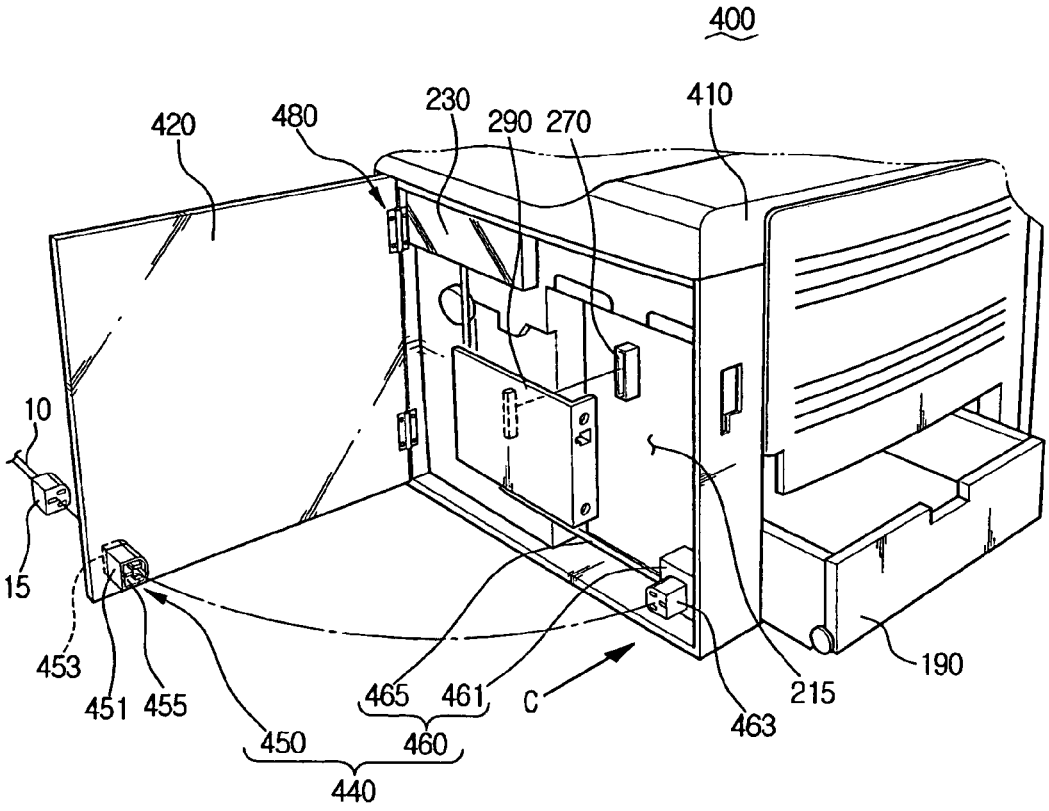
FIG. 5 is a perspective view showing a partial exterior of a laser beam printer according to another embodiment of the present general inventive concept.

FIG. 5 illustrates an electronic apparatus 400 according to another embodiment of the present general inventive concept. According to the embodiment of FIG. 5, the electronic apparatus 400 has an access cover 420 pivotably hinged on a casing 410 by a hinge assembly 480. A direction in which the access cover 420 is mounted on the casing 410 is varied from the embodiments of FIGS. 2-4. Accordingly, a second plug 463 and a second connection portion 455 are disposed at positions so that they are connected to each other in a direction parallel, or substantially parallel to the arrowed direction C.

In the embodiments described above, a printer is exemplified as the electronic apparatus, but this should not be considered as limiting. That is, the present general inventive concept can be applied to any apparatus if it includes an access cover to be opened to provide maintenance or repair work, and a first connection unit and a second connection unit which are capable of automatically shutting off the external power supply when the access cover is open.

As described above, without requiring extra work to shut off the external power supply, the power control unit 230 is automatically disconnected from the external utility power source when the access cover 220, 420 of the electronic apparatus 200, 300, 400 is open. Accordingly, when the access cover 220, 420 is opened to provide the operations such as additional installation of the optional item 290 or replacement of inner parts with new ones, the operation can be safely performed with the external power supply being shut off. Accordingly, accidents, such as electrocution or burns, can be prevented, and damage to the electronic apparatus 200, 300, 400 caused by the electrical shock can also be prevented.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An electronic apparatus comprising:

a casing that houses a power control unit therein and has one side open;

an access cover disposed at the casing to open and close the open side of the casing; and a power supply device, comprising:

a first power connection unit disposed at the access cover, and a second power connection unit to selectively connect an external power source to the first power connection unit in accordance with movements of the access cover opening and closing the open side.

2. The apparatus of claim 1, wherein the second power connection unit is disposed inside the casing and is electrically connected to the power control unit.

3. The apparatus of claim 2, wherein the first connection unit comprises:

a first connection portion exposed to the outside of the casing when the access cover is closed and removably connectable to an external power supply plug of an external power source;

a second connection portion positioned inside the casing when the access cover is closed, to be separably connected to the second power connection unit; and a connection body penetrating through the access cover to electrically connect the first and the second connection portions.

4. The apparatus of claim 3, wherein the first connection portion and the second connection portion are identical to each other in shape.

5. The apparatus of claim 2, wherein the access cover is removably connected to the open side of the casing.

6. The apparatus of claim 2, wherein the casing further comprises a hinge assembly that pivotably connects the access cover to the casing.

7. The apparatus of claim 2, wherein the second power connection unit is disposed on an inner side of the casing adjacent to the open side to be connected to the first power connection unit, and is electrically connected to the power control unit through predetermined power connection means.

8. The apparatus of claim 2, wherein the power control unit is disposed on an inner side of the casing adjacent to the open side, and is integrally formed with the second power connection unit.

9. A power supply device used with an electronic apparatus, comprising:

a power control unit mounted in the electronic apparatus; and a first power connection unit disposed at an access cover that opens and closes a casing of the electronic apparatus and is separably connected to an external utility power source, wherein the first power connection unit is connected to the power control unit when the access cover is closed and is disconnected from the power control unit when the access cover is being opened.

10. The power supply device of claim 9, further comprising a second power connection unit disposed inside the electronic apparatus and electrically connected to the power control unit, wherein the second power connection unit is connected to the first power connection unit when the access cover is closed.

11. The power supply device of claim 10, wherein the first power connection unit comprises:

a first connection portion exposed to the outside of the casing when the access cover is closed, to be removably connected to an external power supply plug connected to an external power source;

a second connection portion positioned inside the casing when the access cover is closed, to be separably connected to the second power connection unit; and a connection body penetrating through the access cover and electrically connecting the first and the second connection portions.

12. The power supply device of claim 11, wherein the first connection portion and the second connection portion are identical to each other in shape.

13. A socket used with an electronic apparatus, comprising:

a socket body fixed to a casing of the electronic apparatus;

a first connection portion disposed at one side of the socket body exposed to the outside of the electronic apparatus to be removably connected to a first plug of an external power cable; and a second connection portion disposed at another side of the socket body provided inside the electronic apparatus to be removably connected to a second plug provided inside the electronic apparatus.

14. The socket of claim 13, wherein the socket body is disposed at an access cover that opens and closes the casing of the electronic apparatus, and the second connection portion and the second plug are connected to and separated from each other in accordance with the movement of the access cover closing and opening the casing of the electronic apparatus.

15. The socket of claim 14, wherein the first connection portion and the second portion are identical to each other in shape.

16. A printer comprising:

a printer body including an opening therein to access an inner portion;

a panel to close and open the opening in the printer body;

a power control unit to supply power to the printer; and a power supply device, comprising:

a first power connection unit to cut off power to the power control unit when the panel is open, and a second power connection unit to connect the first power connection unit to the power control unit when the panel is closed.

17. The printer of claim 16, wherein:

the first power connection unit is disposed at an inner portion of the panel; and the second power connection unit is disposed at an inner portion of the printer.

18. The printer of claim 17, wherein the first power connection unit comprises:

a first connection portion positioned on an inner side of the panel and communicating with an outer side portion of the panel; and a second connection portion connected to the first connection portion and positioned on the inner side of the panel to connect the first connection portion with the second power connection unit when the panel closes the opening of the printer.

19. The printer of claim 18, wherein the first connection portion and the second connection portion are connected to each other by a cable.

20. The printer of claim 18, wherein the first connection portion and the second connection portion are connected with each other by a socket body.

21. The printer of claim 20, wherein the socket body has an L shape.

22. The printer of claim 18, wherein the second power connection unit comprises:

a cable connected to the power control unit; and a plug connected to the cable at a first end and connectable to the second connection portion at another end when the panel closes the opening of the printer.

23. The printer of claim 16, further comprising:

guide rails positioned at the open side of the printer body; and slide protrusions positioned at an inner side of the panel to slide into respective guide rails to connect the panel to the printer body.

24. The printer of claim 16, further comprising hinges rotatably connecting the panel to the printer body at the opening therein.

* * * * *